US010858076B2

(12) United States Patent
Hansen

(10) Patent No.: US 10,858,076 B2
(45) Date of Patent: Dec. 8, 2020

(54) ROV DEPLOYED BUOY SYSTEM

(71) Applicant: Oceaneering International, Inc., Houston, TX (US)

(72) Inventor: Rune Hansen, Dimmelsvik (NO)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 16/433,204

(22) Filed: Jun. 6, 2019

(65) Prior Publication Data

US 2019/0375482 A1 Dec. 12, 2019

Related U.S. Application Data

(60) Provisional application No. 62/681,643, filed on Jun. 6, 2018.

(51) Int. Cl.

| | |
|---|---|
| ***B63G 8/00*** | (2006.01) |
| ***B63B 22/24*** | (2006.01) |
| ***B63C 11/42*** | (2006.01) |
| *B63B 35/00* | (2020.01) |
| *B63B 27/16* | (2006.01) |

(52) U.S. Cl.

CPC ..... *B63B 22/24* (2013.01); *B63C 11/42* (2013.01); *B63B 2027/165* (2013.01); *B63B 2035/008* (2013.01); *B63G 2008/008* (2013.01)

(58) Field of Classification Search

CPC ..... B63B 27/36; B63B 22/003; B63B 45/04; B63B 49/00; B63B 2022/006; B63B 2035/008; B63B 2201/12; B63G 8/41; B63G 8/001

See application file for complete search history.

(56) References Cited

U.S. PATENT DOCUMENTS

| | | | | |
|---|---|---|---|---|
| 4,794,575 | A * | 12/1988 | Miller | B63B 22/003 367/134 |
| 6,261,142 | B1 * | 7/2001 | Fiotakis | A01K 69/06 441/11 |
| 6,525,762 | B1 * | 2/2003 | Mileski | H04N 7/005 348/143 |
| 7,077,072 | B2 * | 7/2006 | Wingett | B63J 3/04 114/312 |
| 7,183,742 | B2 * | 2/2007 | Potter | B63G 8/001 320/101 |
| 7,814,856 | B1 * | 10/2010 | Smith | B63G 8/41 114/313 |
| 8,825,241 | B2 * | 9/2014 | Hine | A01K 61/80 701/21 |
| 8,833,288 | B2 * | 9/2014 | Bertelsen | B63G 8/001 114/326 |
| 2010/0212573 | A1 * | 8/2010 | Hawkes | B63B 22/24 114/328 |
| 2012/0210926 | A1 * | 8/2012 | Storm, Jr. | B63C 11/26 114/337 |

(Continued)

*Primary Examiner* — Gregory W Adams

(74) *Attorney, Agent, or Firm* — Maze IP Law, P.C.

(57) ABSTRACT

A surface buoy comprising a resident electrical power supply allows the surface buoy to be an integrated part of a remotely operated vehicle (ROV) deployed power buoy system which makes transport and installation more efficient than alternatives. The ROV deployed power system can be operational via built in radio link and kept operational during service, transport, testing, installation, and operation.

20 Claims, 7 Drawing Sheets

(56) References Cited

U.S. PATENT DOCUMENTS

| | | | | |
|---|---|---|---|---|
| 2016/0176486 | A1* | 6/2016 | Korneliussen | B63G 8/001<br>114/257 |
| 2016/0375963 | A1* | 12/2016 | Tonnessen | B63B 21/66<br>701/21 |
| 2017/0026085 | A1* | 1/2017 | Kerins | E21B 41/0007 |

* cited by examiner

ROV DEPLOYED BUOY SYSTEM

RELATION TO OTHER APPLICATIONS

This application claims priority through U.S. Provisional Application 62/681,643 filed on Jun. 6, 2018.

BACKGROUND

Buoys, which may house power and/or communications, and remotely operated vehicles (ROV) are typically deployed as two different operations and the systems connected subsea by a separate ROV. There is often a need for one or more additional ROVs to assist during installation and retrieval. This can lead to time consuming and costly installation and retrieval.

FIGURES

Various figures are included herein which illustrate aspects of embodiments of the disclosed inventions.

DESCRIPTION OF EXEMPLARY EMBODIMENTS

Figure 1:
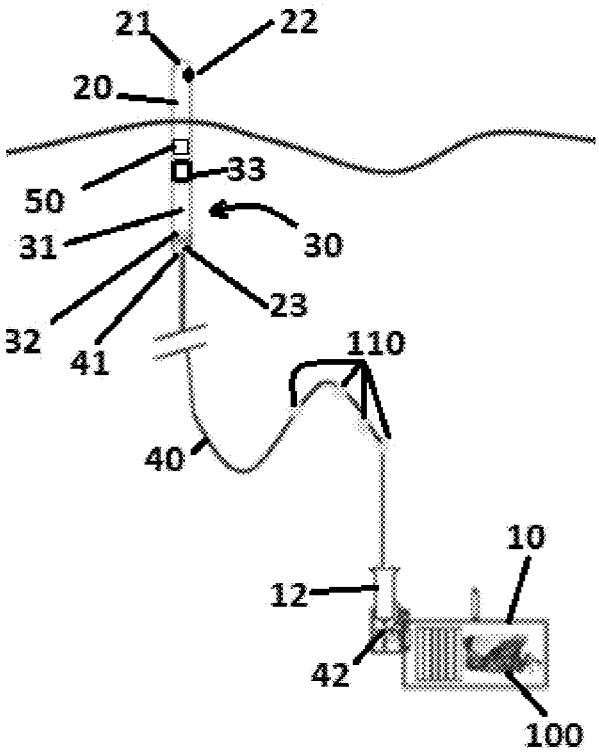
FIG. 1 is a schematic view of an exemplary system once deployed.

In a first embodiment, referring generally to FIG. 1, remotely operated vehicle (ROV) deployed power buoy system 1 comprises remotely operated vehicle (ROV) cage 10; buoy container 12 connected to ROV cage 10; one or more surface buoys 20 selectively releasably disposed at least partially within one or more buoy containers 12, each surface buoy 20 typically comprising electrical power generator 30 disposed at least partially within surface buoy 20; and umbilical 40 operatively disposed intermediate surface buoy 20 and ROV cage 10.

Surface buoys 20 typically comprise an internal winch or hoist 23 operative to aid in deploying umbilical 40, e.g. allowing umbilical 40 to be played out, tensioned, and/or retrieved.

In certain embodiments, one or more buoy sensors 22 may be present. Buoy sensor 22 may comprise one or more buoy position sensors adapted to create monitoring information about surface buoy 20 such as buoy position and behavior.

Electrical power generator 30 may comprise battery 31 and battery management system 32 operatively in communication with battery 31. Electrical power may be provided to electrical power 30 via electrical power source 33 which may comprise solar panels, wind turbines, fueled generators, wave power generators, or the like, or a combination thereof.

Typically, umbilical 40, which may comprise a power conduit and/or a data pathway which can be metal and/or fiber optics as will be familiar to those of ordinary skill in subsea umbilical arts, comprises first connector 41 operatively in communication with electrical power generator 30 and second connector 42 adapted to be connected and to provide electrical power to ROV 100 from electrical power generator 30 such as via second umbilical 45. As used herein ROV 100 may comprise a remotely operated vehicle (ROV), an autonomous underwater vehicle (AUV), a hybrid system, a docking station, vehicle and non-vehicle system, or the like, or a combination thereof.

In embodiments, ROV deployed power buoy system 1 further comprises one or more data communicators 50 disposed at least partially within surface buoy 20 and operatively connected to umbilical 40 and its associated electrical power generator 30. Data communicator 50 main comprise a receiver, transmitter, or a transceiver.

Figure 1A:
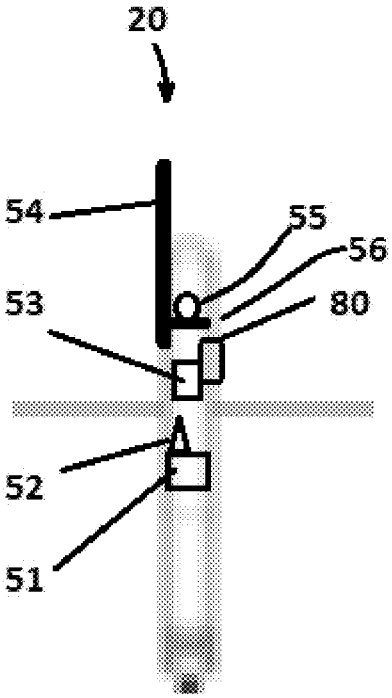
FIG. 1A is a schematic view of an exemplary surface buoy with dual receivers.

In embodiments where data communicator 50 comprises a plurality of transceivers and referring additionally to FIG. 1A, data communicator 50 can comprise first transceiver 51; first antenna 52 disposed at least partially within surface buoy 20 and operatively in communication with first transceiver 51; second transceiver 53; and second antenna 54 operatively in communication with second transceiver 53 and disposed at least partially externally to surface buoy 20. Second antenna 54 may be a selectively extendable antenna. In addition, data logger 55 may be present and in communication with at least one of first transceiver 51 or second transceiver 53. If buoy sensor 22 is present, data logger 55 may be adapted to receive monitoring information about surface buoy 20 from buoy sensor 22 and communicate the monitoring information to an external data receiver.

Figure 5:
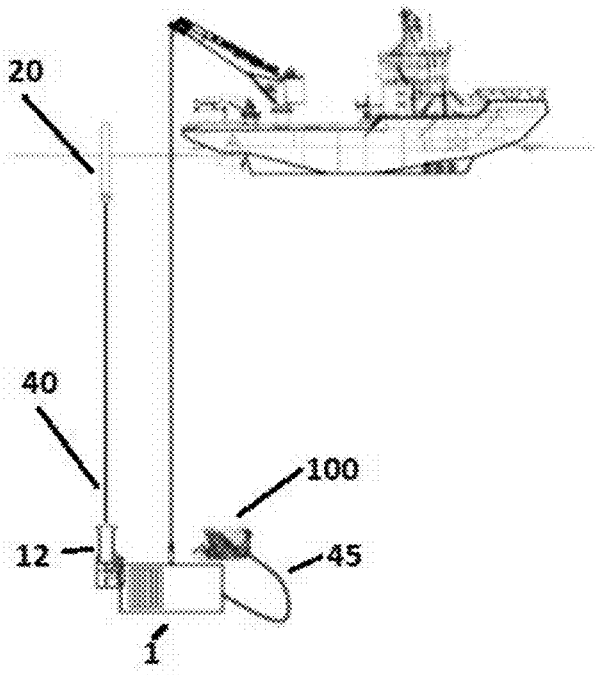
FIG. 5 is a schematic view of an exemplary system being deployed with its ROV exiting from its cage.
Figure 6:
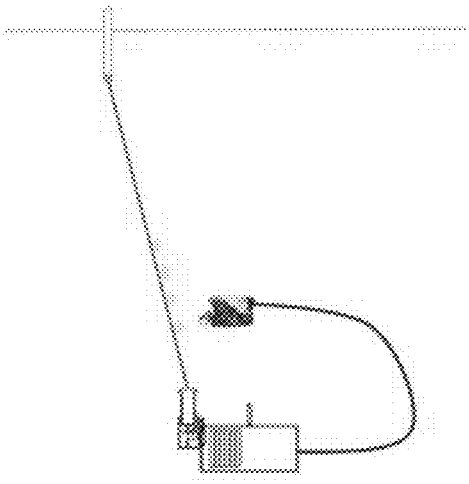
FIG. 6 is a schematic view of an exemplary system with floats being attached.
Figure 7:
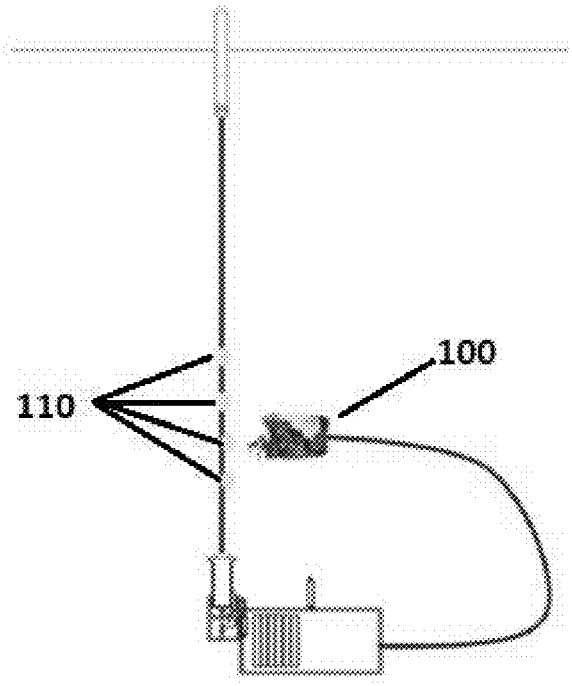
FIG. 7 is a schematic view of an exemplary system with floats attached.

Data logger 55 may further comprise controller 56 which may be adapted to communicate with battery management system 32 to switch ROV deployed power buoy system 1 power on or off or otherwise manage electrical power, e.g. condition the power such as for surges and/or convert or otherwise transform the power from one form into another such as from AC to DC or DC to AC. Controller 56 is typically operatively in communication with ROV 100, if ROV 100 is present, via the data pathway of umbilical 40 and/or second umbilical 45 (FIG. 5).

In certain embodiments, surface buoy 20 comprises buoy presence indicator 21, which can be a solidly lit light, a flashing light, a radar reflective surface, or the like, or a combination thereof.

ROV deployed power buoy system 1 may further comprise one or more video devices 80 disposed on a portion of surface buoy 20 where at least a portion of video device 80 is exposed to air above a surface of the water. One or more such video devices 80 are typically operatively in communication with data communicator 50.

Figure 2:
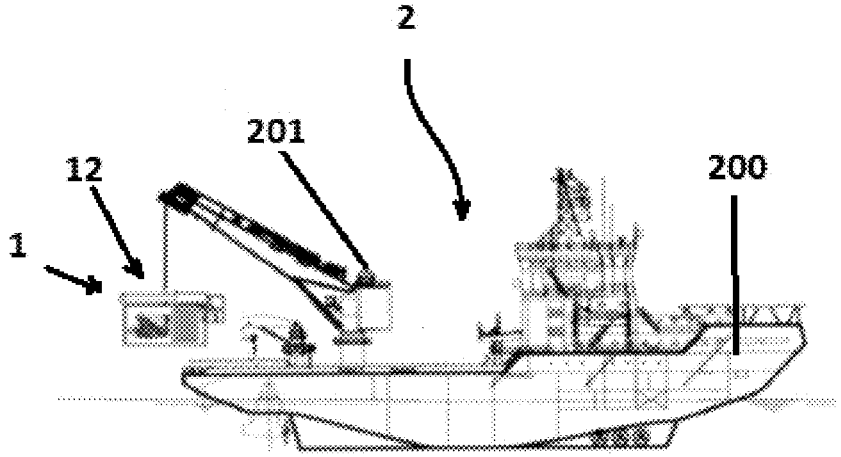
FIG. 2 is a schematic view of an exemplary system being deployed but still above the water.
Figure 3:
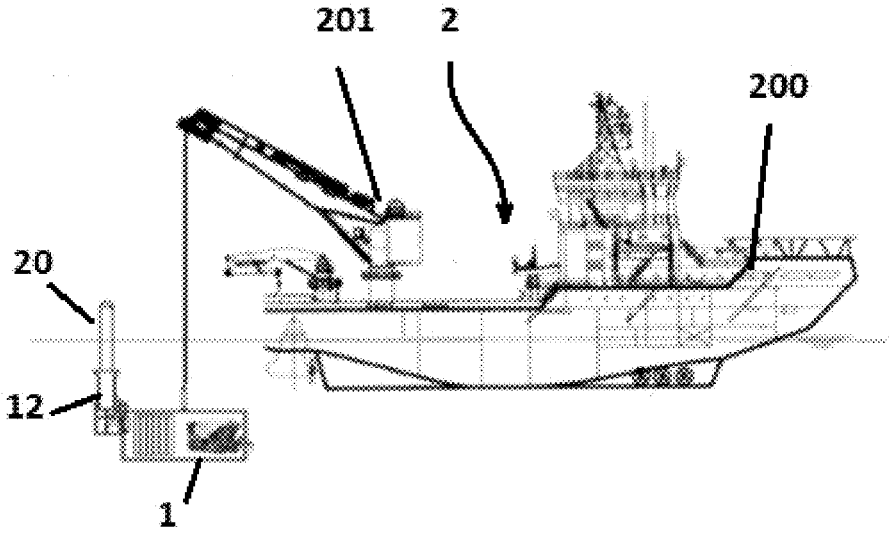
FIG. 3 is a schematic view of an exemplary system being deployed partially into the sea.
Figure 4:
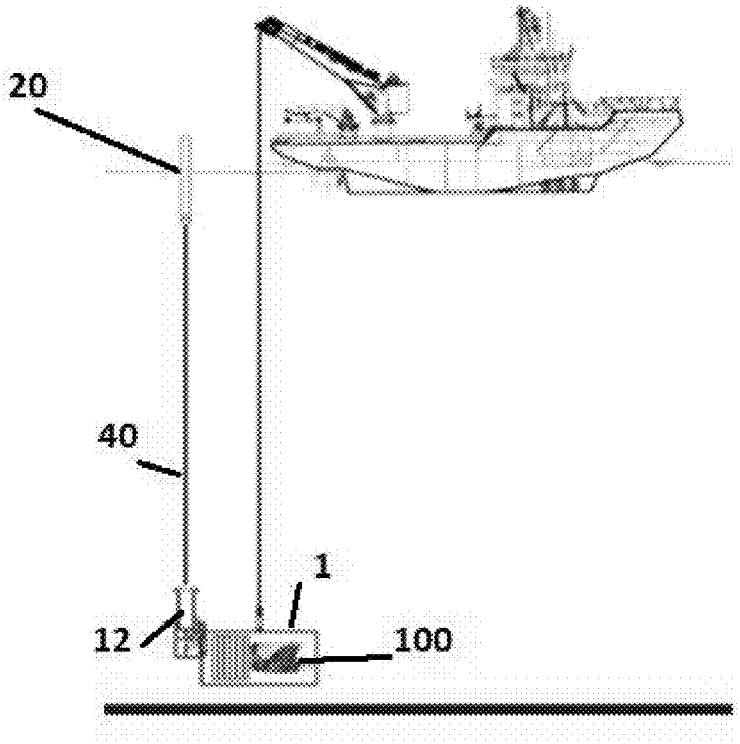
FIG. 4 is a schematic view of an exemplary system being deployed proximate a seabed.

Referring to FIG. 2, remotely operated vehicle (ROV) power system 2 comprises vessel 200; winch 201 disposed at a predetermined portion of vessel 200; and ROV deployed power buoy system 1 connected to winch 201, where ROV deployed power buoy system 1 is as described above. ROV deployed power buoy system 1 and ROV 100, if present, may be transported and deployed as one unit.

In the operation of exemplary methods, installation of ROV deployed power buoy system 1 typically requires less resources and is less time consuming than current methods and can be resident or long deployment installations. Referring to FIGS. 2-12, ROV power system 2, which is as described above, may be deployed by deploying its associated ROV deployed power buoy system 1 into a body of water from vessel 200 and allowing buoy container 12 and its associated surface buoy 20 to pivot from an initial position to a predetermined position relative to the body of water and/or buoy container 12. In embodiments, buoy container 12 is disposed initially in a substantially horizontal position relative to an upper portion of ROV cage 10 and pivots to a substantially vertical position relative to the upper portion of ROV cage 10 upon deployment into the body of water.

ROV cage 10 is lowered to a predetermined depth in the body of water while allowing surface buoy 20 to remain at the surface of the body of water and remain attached to ROV cage 20 via umbilical 40. To do so, remotely operated vehicle power system 2 is typically connected to winch 201 which is used to lower ROV deployed power buoy system 1 to the predetermined depth in the body of water.

Once lowered to the predetermined depth, ROV cage 10 is typically disconnected from vessel 100 and ROV deployed power buoy system 1 released from vessel 100. Electrical power may be then provided by electrical power source 33 (FIG. 1) through, e.g., battery 31 (FIG. 1) and/or battery management system 32 (FIG. 1), via umbilical 40 and, if present, second umbilical 45 (FIG. 5).

In embodiments, surface buoy 20 is released from its associated buoy container 12 after ROV deployed power buoy system 1 has been deployed to the predetermined depth in the body of water.

In certain embodiments, ROV 100 is positioned, e.g. parked, in ROV cage 10 prior to deployment of ROV deployed power buoy system 1 and deployed from ROV cage 10 when the ROV deployed power buoy system 1 has been lowered to the predetermined depth in the body of water. Electrical power may be supplied to ROV 100 from electrical power generator 30 via umbilical 40 and, if present, second umbilical 45 (FIG. 5).

In embodiments where remotely operated vehicle power system 2 further comprises buoy sensor 22 (FIG. 1) and data logger 55 (FIG. 1A) as described above, buoy sensor 22 may be used to receive monitoring information about surface buoy 20 from buoy sensor 21 and that information communicated to an external data receiver. Via the monitoring information, equipment integrity and functionality can be queried and verified.

Where umbilical 40 further comprises a data pathway, data logger 55 (FIG. 1A) may further comprise controller 56 (FIG. 1A) operatively in communication with ROV 100 via the data pathway and, if present, a similar data pathway in umbilical 41 (FIG. 5). In these embodiments, one or more commands may be received to effect an ROV function from a location remote to ROV 100 via data communicator 50 (FIG. 1) and passed on to controller 56 which can then perform one or more actions, or cause the actions to occur, which effect the ROV function using the received command, e.g. navigate or perform a subsea function.

ROV deployed power buoy system 1 may be retrieved, e.g. back to vessel 1, when so desired. When retrieved, ROV cage 10 is typically connected to vessel 200, such as using winch 201, and retrieved to the surface of the body of water. Buoy container 12 may be allowed to return to its initial position, e.g. a substantially horizontal position relative to the upper portion of ROV cage 10, upon retrieval of ROV deployed power buoy system 1 to vessel 200.

Figure 8:
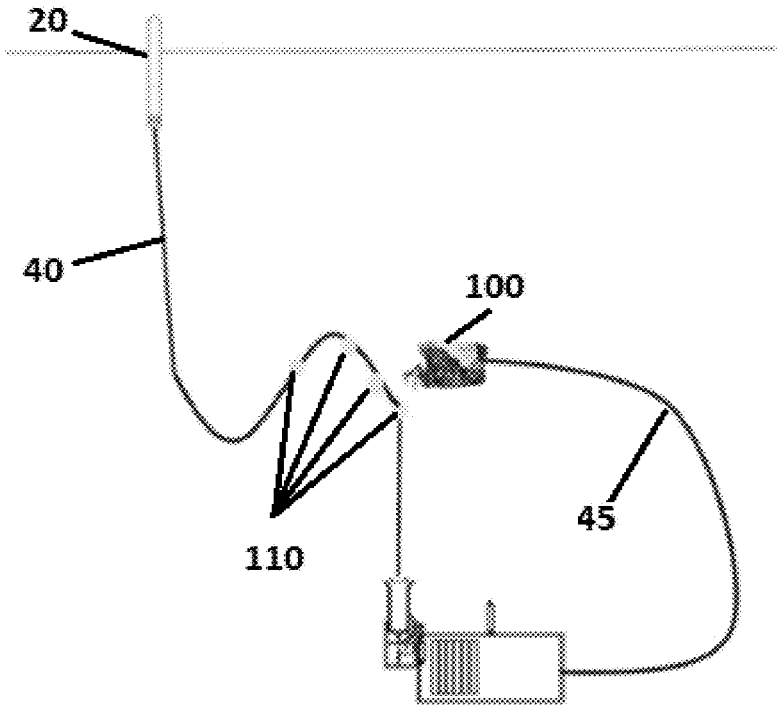
FIG. 8 is a schematic view of an exemplary system with floats attached and umbilical positioned.
Figure 9:
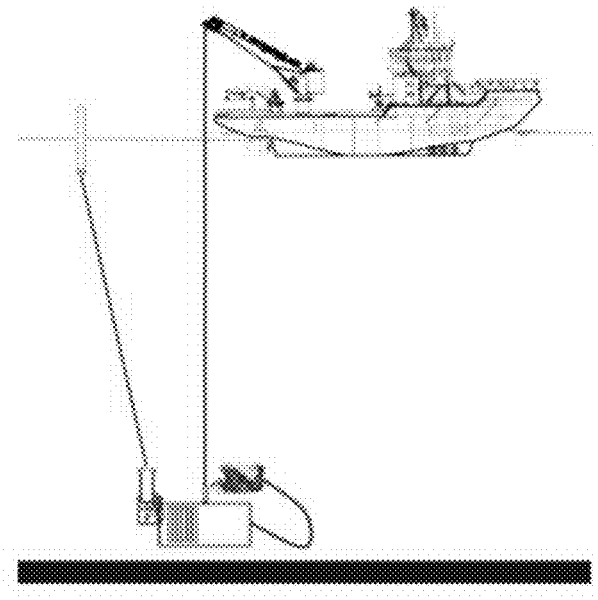
FIGS. 9-13 are schematic views of a deployed exemplary system being retrieved back to a vessel.
Figure 10:
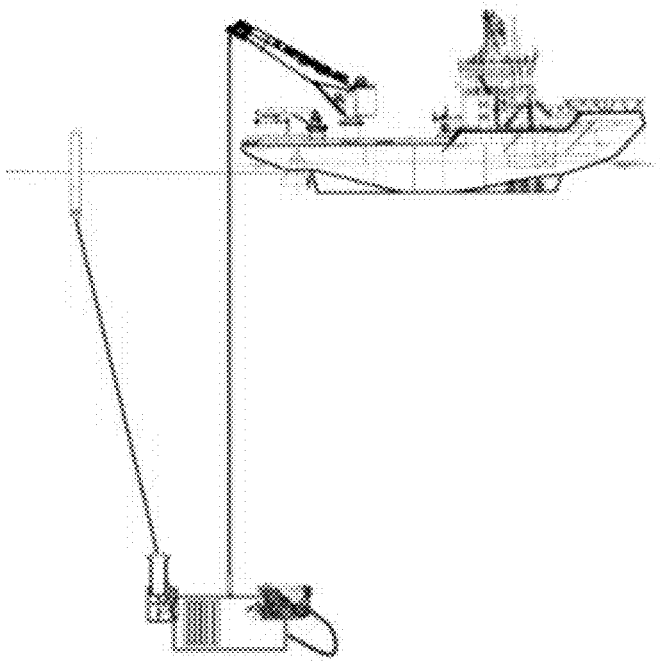
Figure 11:
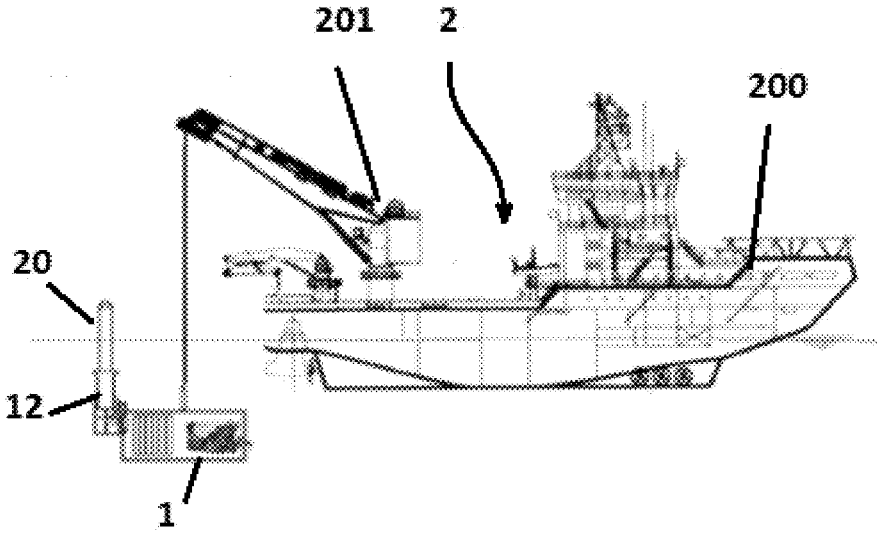
Figure 12:
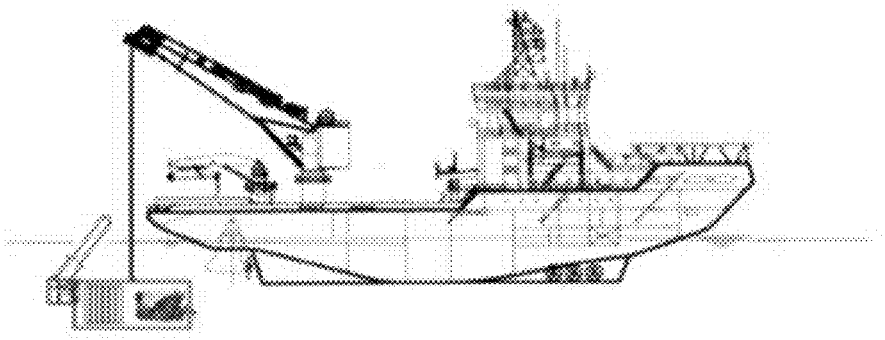
Figure 13:
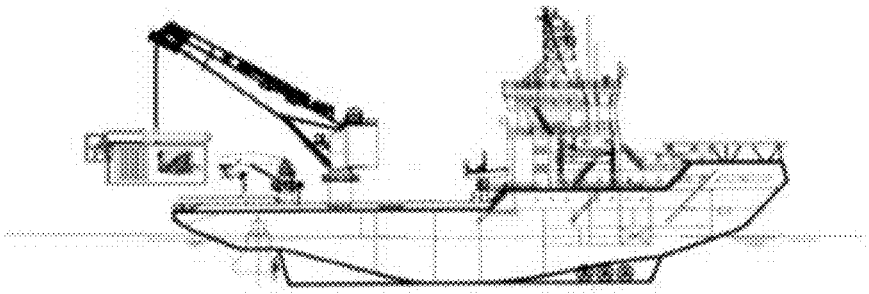

In certain embodiments, one or more floats 110 (FIG. 6) may be attached to umbilical 40, such as by using ROV 100, which may then be positioned into a predetermined shape using attached floats 110 (FIG. 8). Where floats 110 are attached, floats 110 may be removed when ROV deployed power buoy system 1 is to be retrieved, again such as by ROV 100.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A remotely operated vehicle (ROV) deployed buoy system, comprising:
- a. a remotely operated vehicle (ROV) cage;
- b. a buoy container pivotally connected to the ROV cage;
- c. a surface buoy selectively releasably disposed at least partially within the buoy container;
- d. an electrical power generator disposed at least partially within the surface buoy; and
- e. an umbilical comprising:
  - i. an electrical power pathway operatively disposed intermediate the surface buoy and the ROV cage;
  - ii. a first connector operatively in communication with the electrical power generator and the electrical power pathway; and
  - iii. a second connector adapted to be connected to an ROV and to provide electrical power to the ROV from the electrical power generator, the second connector operatively in communication with the electrical power generator and the electrical power pathway.

2. The remotely operated vehicle (ROV) deployed buoy system of claim 1, further comprising a data communicator at least partially disposed within the surface buoy, the data communicator operatively connected to the umbilical and to the electrical power generator.

3. The remotely operated vehicle (ROV) deployed buoy system of claim 2, wherein the data communicator comprises a transceiver.

4. The remotely operated vehicle (ROV) deployed buoy system of claim 2, wherein the data communicator comprises:
- a. a first transceiver;
- b. a first antenna operatively in communication with the first transceiver, the first antenna disposed at least partially within the surface buoy;
- c. a second transceiver; and
- d. a second antenna operatively in communication with the second transceiver, the second antenna disposed at least partially externally to the surface buoy.

5. The remotely operated vehicle (ROV) deployed buoy system of claim 4, wherein the second antenna comprises a selectively extendable antenna.

6. The remotely operated vehicle (ROV) deployed buoy system of claim 1, wherein the surface buoy further comprises:
- a. a buoy presence indicator; and
- b. an internal winch operative to aid in deploying the umbilical.

7. The remotely operated vehicle (ROV) deployed buoy system of claim 6, wherein the buoy presence indicator comprises a light, a flashing light, or a radar reflective surface.

8. A remotely operated vehicle (ROV) power system, comprising:
- a. a vessel;
- b. a winch disposed at a predetermined portion of the vessel;

c. a remotely operated vehicle (ROV) deployed buoy system connected to the winch, the ROV deployed power buoy system comprising:
   i. a remotely operated vehicle (ROV) cage;
   ii. a buoy container pivotally connected to the ROV cage;
   iii. a surface buoy selectively releasably disposed at least partially within the buoy container;
   iv. an electrical power generator disposed at least partially within the surface buoy; and
   v. an umbilical comprising:
      1. an electrical power pathway operatively disposed intermediate the surface buoy and the ROV cage;
      2. a first connector operatively in communication with the electrical power generator and the electrical power pathway; and
      3. a second connector adapted to be connected to an ROV and to provide electrical power to the ROV from the electrical power generator, the second connector operatively in communication with the electrical power generator and the electrical power pathway.

9. The ROV power system of claim 8, further comprising:
a. a buoy sensor; and
b. a data logger, the data logger in communication with at least one of the first transceiver or the second transceiver, the data logger adapted to receive monitoring information about the surface buoy from the buoy sensor and communicate the monitoring information to an external data receiver.

10. The ROV power system of claim 9, further comprising a video device disposed on a portion of the surface buoy exposed to air above a surface of the water, the video device operatively in communication with the data communicator.

11. The ROV power system of claim 10, wherein the buoy sensor comprises a buoy position sensor and the monitoring information about the surface buoy comprises buoy position and behavior.

12. The ROV power system of claim 10, wherein the data logger further comprises a controller.

13. The ROV power system of claim 12, wherein the controller is further adapted to communicate with a battery management system which is operatively in communication with the electrical power supply to switch ROV deployed power buoy system power on or off or manage electrical power by conditioning the electrical power or converting the electrical power from one form into another.

14. The ROV power system of claim 8, wherein the electrical power generator comprises a battery and a battery management system operatively in communication with the battery.

15. A method of deploying a remotely operated vehicle (ROV) power system that comprises a vessel; a winch disposed at a predetermined portion of the vessel; a remotely operated vehicle (ROV) deployed buoy system connected to the winch, the ROV deployed power buoy system comprising a remotely operated vehicle (ROV) cage; a buoy container pivotally connected to the ROV cage; a surface buoy selectively releasably disposed at least partially within the buoy container; an electrical power generator disposed at least partially within the surface buoy; and an umbilical operatively disposed intermediate the surface buoy and the ROV cage, the umbilical comprising a power pathway, a first connector operatively in communication with the electrical power generator, and a second connector adapted to be connected to an ROV and to provide electrical power to the ROV from the electrical power generator, the method comprising:
a. deploying the ROV deployed power buoy system into a body of water from the vessel to a predetermined depth in the body of water;
b. allowing the buoy container and its associated surface buoy to pivot from an initial position to a predetermined second position;
c. lowering the ROV cage to a predetermined depth in the body of water while allowing the surface buoy to remain at the surface of the body of water and remain attached to the ROV cage via the umbilical;
d. disconnecting the ROV cage from the vessel;
e. using the electrical power generator to generate electrical power; and
f. transferring the generated electrical power to the ROV via the umbilical.

16. The method of claim 15, wherein the buoy container is disposed initially in a substantially horizontal position relative to an upper portion of the ROV cage and pivots to a substantially vertical position relative to the upper portion of the ROV cage upon deployment into the body of water.

17. The method of claim 15, wherein deploying the ROV deployed power buoy system into a body of water from the vessel further comprises releasing the surface buoy from its associated the buoy container after the ROV deployed power buoy system has been deployed to the predetermined depth in the body of water.

18. The method of claim 15, further comprising:
a. positioning an ROV in the ROV cage prior to deployment of the ROV deployed power buoy system;
b. deploying the ROV from the ROV cage when the ROV deployed power buoy system has been lowered to a predetermined depth in the body of water; and
c. supplying electrical power to the ROV from the electrical power generator via the umbilical.

19. The method of claim 15, wherein the ROV deployed power buoy system further comprises a data communicator comprising a first transceiver, a first antenna disposed at least partially within the surface buoy and operatively in communication with the first transceiver, a second transceiver, and a second antenna operatively in communication with the second transceiver and disposed at least partially externally to the surface buoy; a buoy sensor; and a data logger which is in communication with at least one of the first transceiver or the second transceiver, the method further comprising:
a. using the buoy sensor to receive monitoring information about the surface buoy from the buoy sensor; and
b. communicating the monitoring information to an external data receiver.

20. The method of claim 15, further comprising releasing the ROV deployed power buoy system from the vessel after the ROV deployed power buoy system is deployed into the body of water.

* * * * *